US007713098B2

(12) United States Patent
Trout et al.

(10) Patent No.: US 7,713,098 B2
(45) Date of Patent: May 11, 2010

(54) SINGLE USE SECURITY MODULE MEZANNINE CONNECTOR

(75) Inventors: David A. Trout, Lancaster, PA (US); James L. Fedder, Etters, PA (US); Attalee S. Taylor, Palmyra, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/313,449

(22) Filed: Nov. 20, 2008

(65) Prior Publication Data

US 2009/0075503 A1 Mar. 19, 2009

Related U.S. Application Data

(62) Division of application No. 11/751,744, filed on May 22, 2007, now Pat. No. 7,470,129.

(51) Int. Cl.
*H01R 13/42* (2006.01)

(52) U.S. Cl. ..... 439/751; 439/660; 439/943

(58) Field of Classification Search ..... 439/751, 439/733.1, 660, 74, 943; 29/845, 629
See application file for complete search history.

(56) References Cited

U.S. PATENT DOCUMENTS

| | | | | |
|---|---|---|---|---|
| 4,050,769 | A * | 9/1977 | Ammon | 439/701 |
| 5,094,623 | A * | 3/1992 | Scharf et al. | 439/101 |
| 5,624,277 | A * | 4/1997 | Ward | 439/620.09 |
| 2003/0049972 | A1 * | 3/2003 | Aoki | 439/751 |
| 2005/0221687 | A1 * | 10/2005 | Nakamura et al. | 439/751 |
| 2006/0246786 | A1 * | 11/2006 | Noguchi | 439/751 |

* cited by examiner

*Primary Examiner*—Hien Vu

(57) ABSTRACT

An electrical connector assembly includes an electrical connector and a tool. The electrical connector includes a contact having a compliant jog section disposed between first and second ends of the contact. The tool is required to press-fit the connector to an electrical device without deforming the compliant jog section of the contact.

3 Claims, 15 Drawing Sheets

SINGLE USE SECURITY MODULE MEZANNINE CONNECTOR

CROSS-REFERENCE TO RELATED APPLICATIONS

This is a divisional application of application Ser. No. 11/751,744 filed May 22, 2007 now U.S. Pat. No. 7,470,129.

FIELD OF THE INVENTION

The present invention relates to electrical connectors. More specifically, the present invention relates to a mezzanine-style electrical connector for connecting a first electrical component to a second electrical component.

BACKGROUND OF THE INVENTION

Electrical connectors provide signal and power connection between electronic devices using signal and power contacts supported within a connector housing. For example, computers and other electronic devices often include a plurality of interconnected printed circuit boards (PCBs) connected by electrical connectors. It is common for a computer to have a motherboard and one or more other boards that execute or perform specialized operations or tasks. These specialized boards are often referred to as daughter cards. The connectors connecting these PCBs provide for the transfer of power and/or control signals between the PCBs.

A connector which includes a housing and contacts is attached to a first PCB, such as a daughter card, by connecting one end of the contacts on a first side of the connector housing to electrical contacts on a surface of the first circuit board. Often, this connection is made by soldering so as to permanently attach the connector to the first PCB. The connector is then attached to a second PCB, which may be a motherboard, by press-fitting leads of the contacts on a second side of the connector into plated through holes of the second PCB. In such a manner, the connector provides an electrical connection, as well as a physical connection, between the two circuit boards. Since the connector is attached by a removable press-fit connection with the second PCB, the first PCB along with the connector, may be removed from the second PCB and reused.

It some circumstances, it may be desirable to provide a security measure to prohibit or deter removing a first PCB from a second PCB, for example, to prohibit the first PCB from being reused. At this time, no practical system or method has been developed to render inoperative a first PCB when removed from a second PCB.

Furthermore, no practical method has been developed to render unusable a connector attached to a first electrical device when removed from a second electrical device or another connector attached to another electrical device.

Therefore, there is an unmet need to provide an electrical connector which is rendered unusable upon separation from an electrical device or another connector to which the connector has been previously joined.

SUMMARY OF THE INVENTION

An electrical connector assembly providing for a single use connection is disclosed. The electrical connector is rendered unusable after being removed from an electrical device or other connector to which the connector has been previously joined.

In a first embodiment of the electrical connector assembly, the connector includes a housing, at least one electrical contact supported by the housing, and a tool that mates with the housing, wherein the at least one electrical contact comprises a first end configured to make a first connection with a first electrical device, a second end configured to make a second connection with a second electrical device, and a compliant jog section disposed between the first end and the second end and wherein the compliant jog section is configured to deform when attempting to connect the second end to the second electrical device without the tool mated to the housing so as to prevent the second end from making the second connection with the second electrical device.

The connector of the first embodiment further includes wherein the first end is a solder lead and the second end is a press-fit connection, and further includes wherein the second end comprises a compliant eye-of-the-needle tail. The connector housing has an open slot for receiving the tool.

In a second embodiment of the electrical connector assembly, the connector includes a first housing and a standard contact, and a second connector comprising a second housing, a standard contact and a modified contact, wherein the first connector and the second connector are configured to mate so as to engage the standard contact of the first connector and the modified contact of the second connector, and wherein the modified contact of the second connector is deformed and rendered unusable when the second connector is un-mated from the first connector.

The connector assembly of the second embodiment further includes wherein the first housing and the second housing are substantially identical. The connector assembly of the second embodiment additionally includes wherein the second housing comprises a standard slot configured to support the standard contact and a modified slot configured to support the modified contact, and wherein the first connector housing comprises a slot overhang configured to deform the modified contact of the second connector when the second connector is un-mated from the first connector.

The connector assembly of the second embodiment additionally includes wherein the second connector housing further comprises at least two standard slots and at least two modified slots. The connector assembly also includes wherein the second connector housing further comprises a first row of five standard slots and five modified slots and a second row of five standard slots and five modified slots, and wherein the standard and the modified slots of each row are individually staggered.

The connector assembly of the second embodiment further includes wherein the standard contact of the first connector and the standard contact of the second connector are substantially identical, and wherein the standard contact of the first connector comprises a first end configured to make a first connection with an electrical device, a second end configured to make a second connection with either a standard contact or a modified contact, and wherein the modified contact of the second connector comprises a first end configured to make a first connection with a second electrical device, and a second end configured to make a second connection with either a standard contact or a modified contact.

The connector assembly of the second embodiment also includes wherein the first connector further comprises a modified contact that is substantially identical to the modified contact of the second connector, and also includes wherein the modified contact of the first connector further comprises a frangible section that has a lower tensile strength compared to any other section of the modified contact and that is configured to bend or break when the second connector is un-mated from the first connector, and also includes wherein the first electrical device is a motherboard and the second electrical device is a daughter card.

In a method of electrically connecting a first electrical device to a second electrical device, a method is disclosed that includes providing a first electrical device, connecting a first connector comprising a first housing and a standard contact to the first electrical device to make a first electrical connection, providing a second electrical device, and connecting a second connector comprising a second housing, a standard electrical contact and a modified electrical contact to the second electrical device to make a second electrical connection, and mating the first connector to the second connector to form an electrical connection between the first electrical device and the second electrical device, wherein the first housing and the second housing are substantially identical, and wherein the modified contact of the second connector is deformed and rendered unusable when the second connector is un-mated from the first connector.

The method further includes wherein the first housing comprises a standard slot for supporting the standard electrical contact and a modified slot for supporting the modified electrical contact, and wherein the first housing comprises a slot overhang configured to deform the modified electrical contact of the second connector when the second connector is un-mated from the first connector. The method additionally includes wherein the standard contact of the first connector comprises a first end configured to make a first connection with the first electrical device, a second end configured to make a second connection with either a standard contact or a modified contact, and wherein the standard contact of the first connector is substantially identical to the standard electrical contact of the second connector, and wherein the modified electrical contact of the second connector comprises a first end configured to make a second connection with the second electrical device, and a second end configured to make a second connection with either a standard contact or a modified contact.

The method also includes wherein the first connector further comprises a modified electrical contact that is substantially identical to the modified contact of the second connector and wherein the modified electrical contact of the second connector further comprises a frangible section that has a lower tensile strength compared to any other section of the modified electrical contact. The method further includes wherein the first electrical device is a motherboard and the second electrical device is a daughter card.

Further aspects of the method and system are disclosed herein. The features as discussed above, as well as other features and advantages of the present invention will be appreciated and understood by those skilled in the art from the following detailed description and drawings.

DETAILED DESCRIPTION OF THE INVENTION

The present invention now will be described more fully hereinafter with reference to the accompanying drawing, in which preferred embodiments of the invention are shown. This invention may, however, be embodied in many different forms and should not be construed as limited to the embodiments set forth herein; rather, these embodiments are provided so that this disclosure will be thorough and complete and will fully convey the scope of the invention to those skilled in the art.

Figure 1:
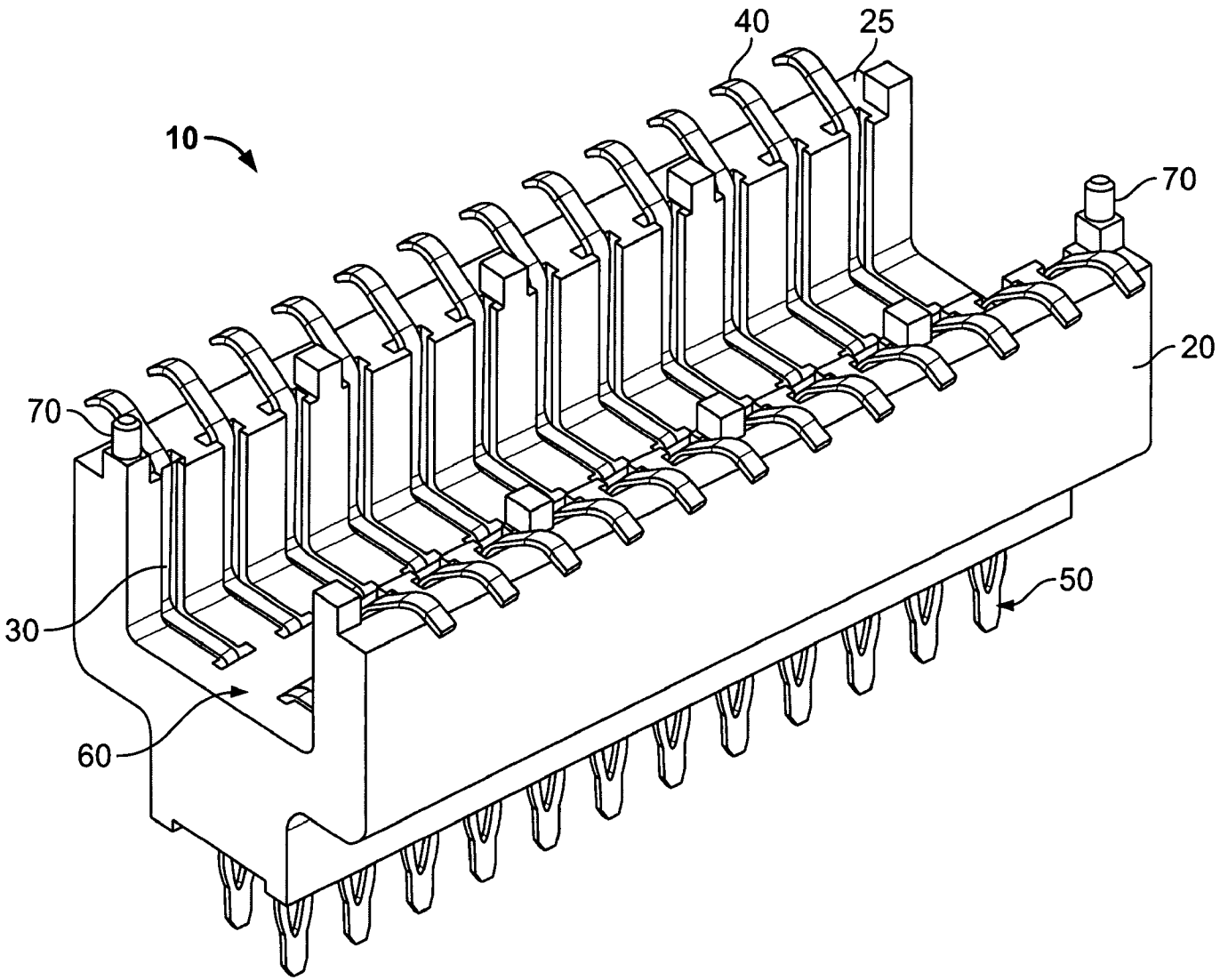
FIG. 1 illustrates an exemplary electrical connector according to a first embodiment of the invention.

Referring to FIG. 1, a first embodiment of the single use security module connector 10 is depicted. The connector 10 includes a housing 20 and contacts 30. Contacts 30 include leads 40 and compliant tails 50. The contacts 30 extend through the housing 20 between the leads 40 and the tails 50.

The housing 20 includes an open slot 60 and alignments posts 70. The housing 20 is shown with two posts 70 on the lead side surface 25 of the housing 20. The posts 70 align the housing 20 with a first electrical device such as a printed circuit board (PCB), and more particularly with a daughter card. Although two posts 70 are preferable, it is within the scope of the invention to include fewer posts, additional posts, or other alignment structures.

Figure 2:
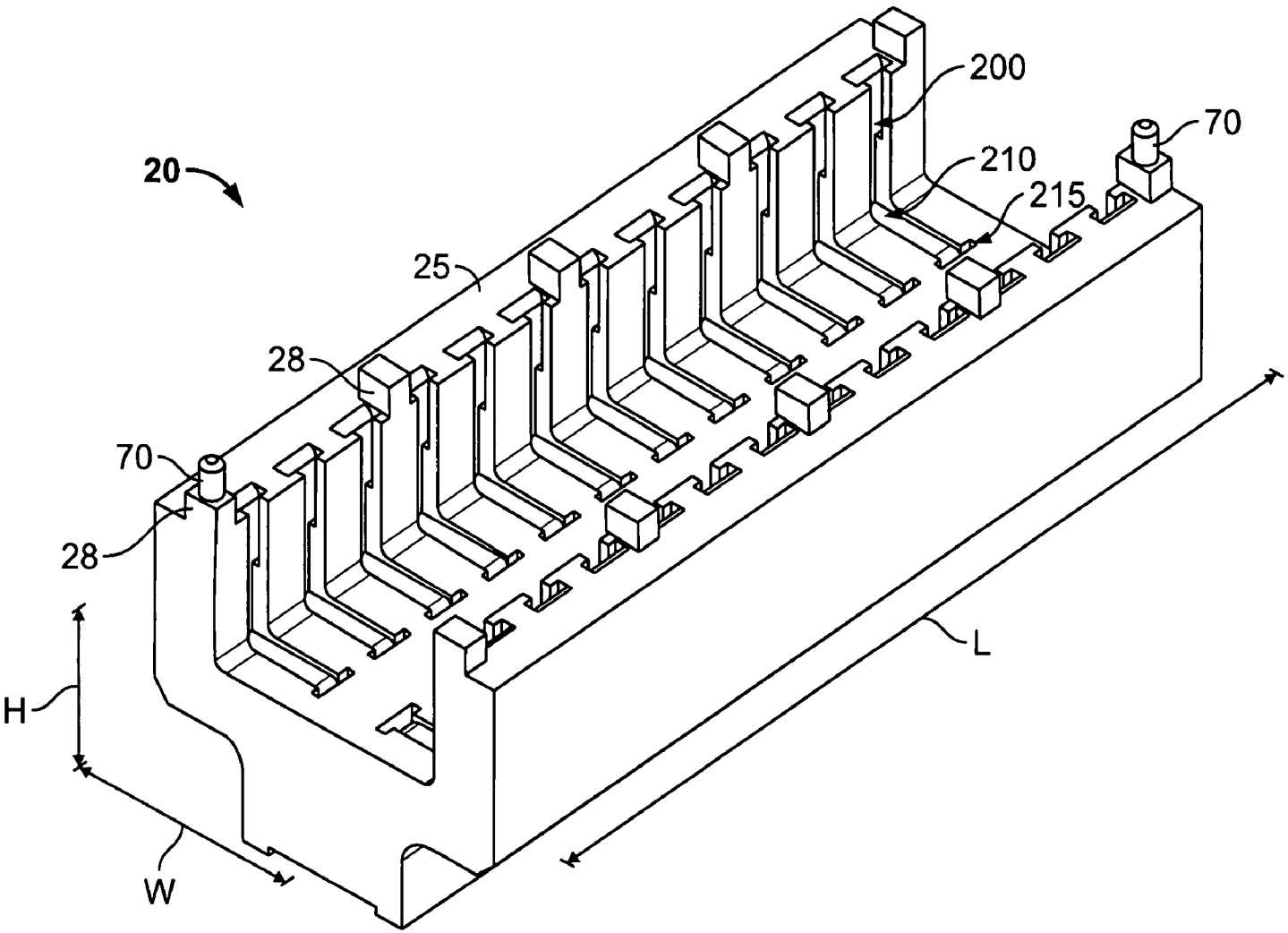
FIG. 2 illustrates an exemplary connector housing according to a first embodiment of the invention.
Figure 6:
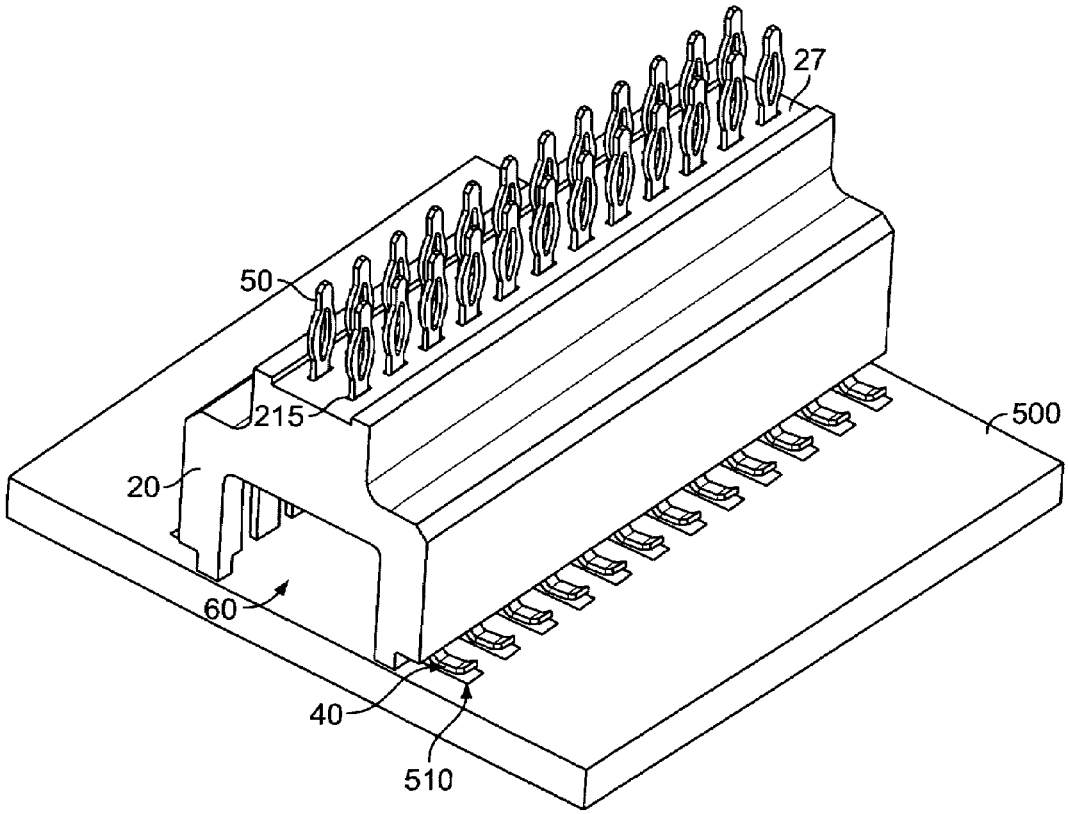
FIG. 6 illustrates an exemplary arrangement of the connector according to the first embodiment connected to an exemplary daughter card.

A detailed illustration of housing 20 is shown in FIG. 2. The open slot 60 is shown having a length L, a width W, and a height H. As further shown in FIG. 2, housing 20 includes an upper contact groove 200, a lower contact groove 210 and a lower slot 215 for supporting the contact 30. The lower slot 215 extends from the lead side surface 25 to allow the tail 50 to exit the tail side surface 27 of the housing 20 as shown in FIG. 6. The housing further includes standoffs 28. The standoffs 28 provide for a separation between the lead side surface 25 of the housing 20 and an electrical device to which the leads 40 may be connected. As shown, the standoffs 28 may support alignment posts 70.

Figure 3:
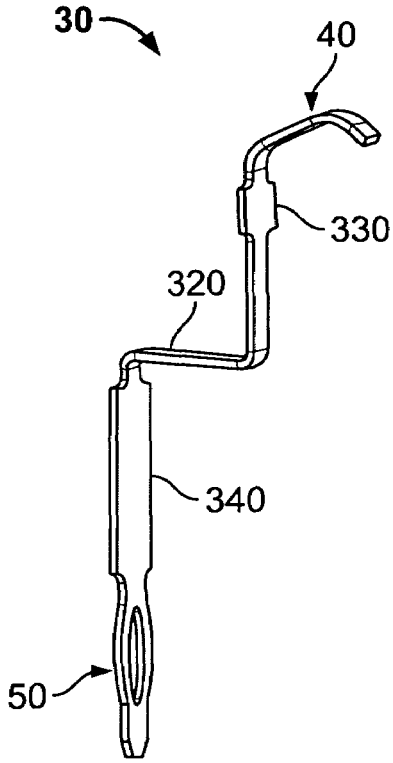
FIG. 3 illustrates a detailed view of an exemplary contact according to a first embodiment of the invention.

A detailed illustration of contact 30 is shown in FIG. 3. As shown in FIG. 3, the contact 30 has a lead 40 and a compliant eye-of-the-needle tail 50. The contact includes a compliant jog section 320, a T-section 330, and a lower section 340. The compliant eye-of-the-needle tail 50 is configured to compress when pushed into a through hole or other receiving structure of a second electrical device to form a friction fit with good electrical contact.

The contact 30 is loaded into the housing 20 by inserting the tail 50 into the lower slot 215 while the T-section 330 is aligned to enter the upper contact groove 200. The contact 30 is inserted until the jog section 320 seats in the lower contact groove 210 which is open to the slot 60. The T-section 330 frictionally fits within the upper contact groove 200 to support the contact 30 in the housing 20. The tails 50 extend beyond the tail side surface 27 as shown in FIG. 6.

Figure 4:
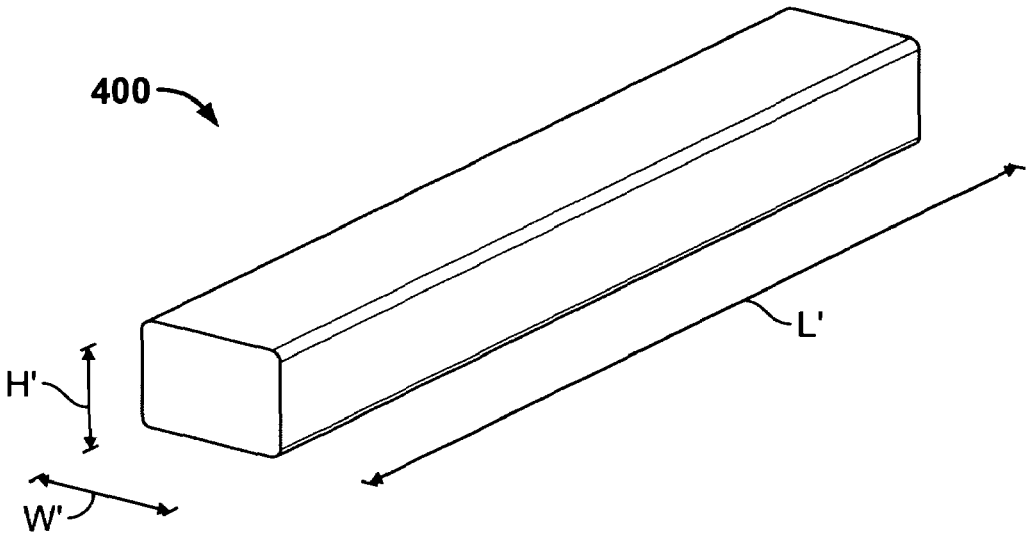
FIG. 4 illustrates an exemplary connector tool according to a first embodiment of the invention.

An installation tool 400 is shown in FIG. 4. Installation tool 400 is designed to fit within open slot 60 of housing 20, and is formed with a length L', a width W', and a height H' as shown in FIG. 4. The length L' of installation tool 400 is preferably slightly longer than the length L of open slot 60. The width W' and height H' of the installation tool 400 are slightly less than the corresponding width W and height H of the open slot 60 so as to provide a snug fit of the tool 400 into the open slot 60.

Figure 5:
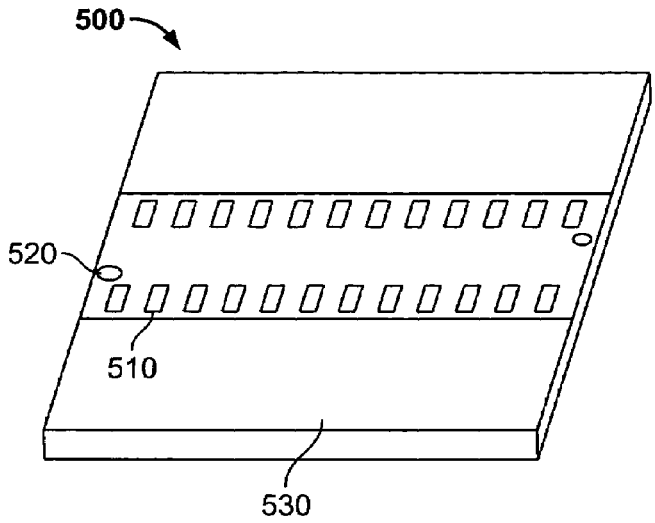
FIG. 5 illustrates a first exemplary daughter card.

A first exemplary daughter card 500 is shown in FIG. 5. Daughter card 500 includes surface mount pads 510 and alignment holes 520 on a daughter card surface 530. Surface mount pads 510 correspond to the leads 40 of connector 10 as shown on FIG. 1. Alignment holes 520 correspond to alignment posts 70 of connector 10 as shown on FIG. 1. Alignment holes 520 may pass through the daughter card 500 or may be recessed into the daughter card 500.

When the posts 70 of the connector are aligned with corresponding alignment holes 520 on the daughter card 500, the leads 40 are aligned with the surface mount pads 510 on the daughter card 500. The standoffs 28 create a space between the lead side surface 25 of the housing 20 and the daughter card surface 530 that facilitates soldering the leads 40 to the pads 510.

As shown in FIG. 6, the connector 10 is attached to a first electrical device, in this embodiment a daughter card 500. Alignment posts 70 (not shown) are positioned in alignment holes 520 (not shown) and the leads 40 of the connector 10 are soldered to the corresponding surface mount pads 510 of daughter card 500. Open slot 60 faces the daughter card 500 as shown in FIG. 6. In such a manner, an electrical connection is established between the tails 50 and the daughter card 500. Optional alignment posts (not shown) may be provided on the tail side surface 27 of the housing 20.

Figure 7:
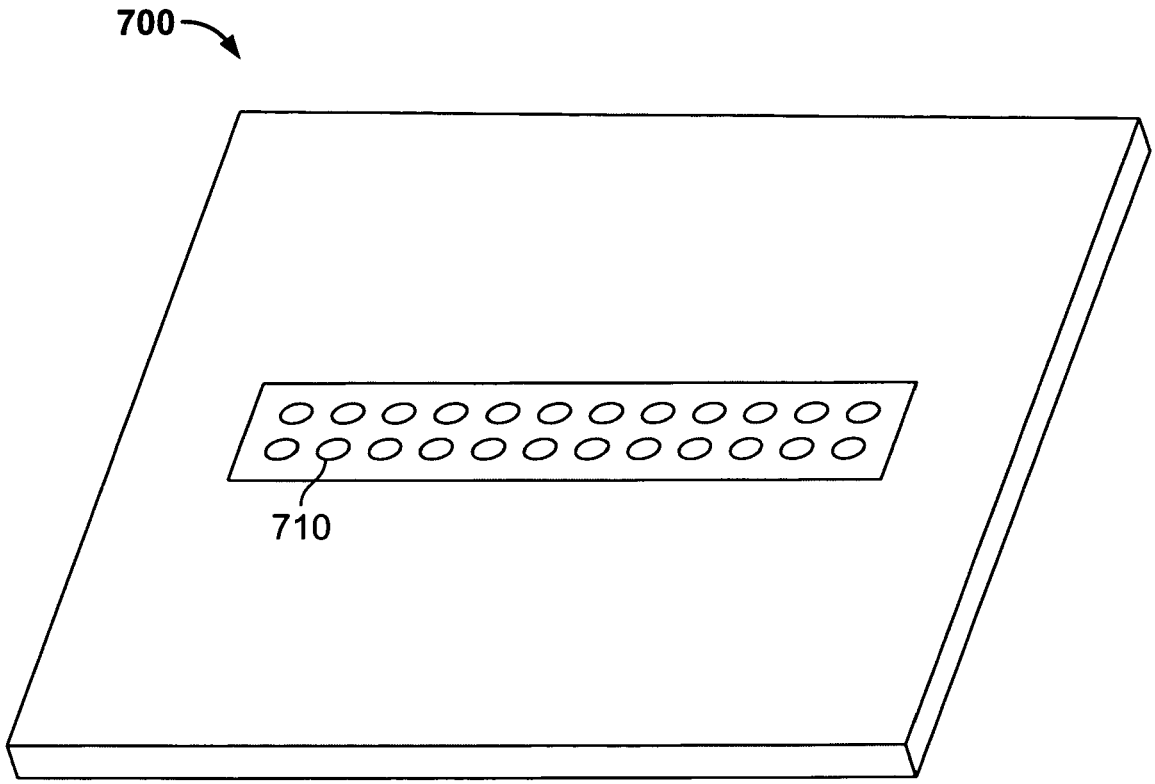
FIG. 7 illustrates a first exemplary motherboard.

A first exemplary motherboard 700 as shown in FIG. 7 is then provided. Motherboard 700 includes through holes 710. Through holes 710 provide electrical connectivity to electrical pathways (not shown) on the motherboard 700. The motherboard 700 may have optional alignment holes (not shown) for receiving optional alignment posts of the connector 10 (not shown).

Figure 8:
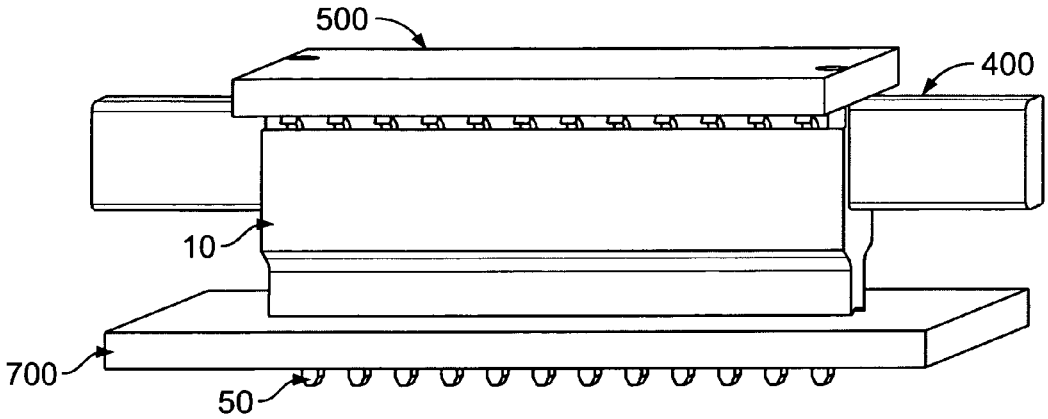
FIG. 8 illustrates an exemplary arrangement of the first embodiment of the connector attached to an exemplary daughter card being further attached to an exemplary motherboard.
Figure 9:
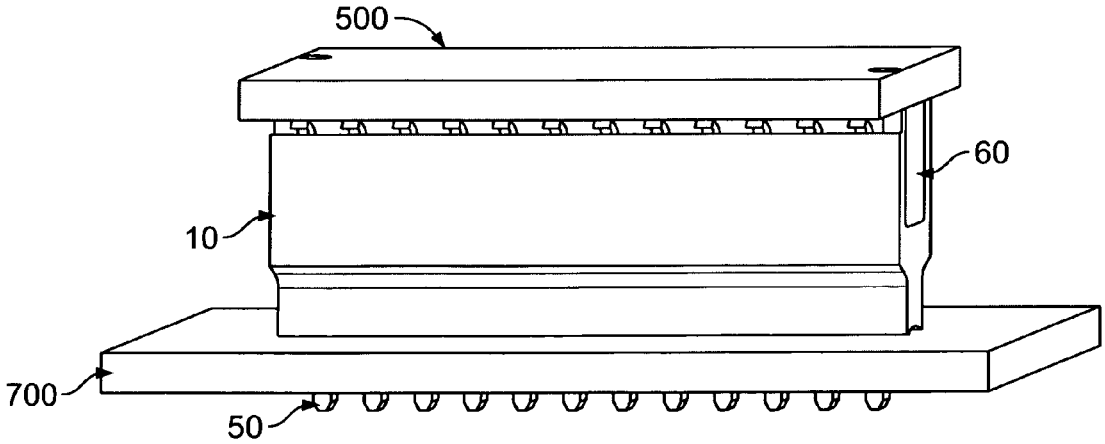
FIG. 9 illustrates an exemplary arrangement of the first embodiment of the connector connecting an exemplary daughter card to an exemplary motherboard.

To connect the connector 10 connected to the daughter card 500 to the motherboard 700, the tool 400 is inserted into the open slot 60 between the connector 10 and the daughter card 500. The tails 50 of the connector 10 are then aligned and press-fit through the through holes 710 of the motherboard 700 as shown in FIG. 8. The tool 400 prevents the tails 50 from being pushed up into the housing 20 and bending the compliant jog section 320 shown in FIG. 3 into the open slot 60 shown in FIG. 6. The tool 400 is then removed from the slot 60. In such a manner, an electrical connection is established between the motherboard 700 and the daughter card 500 through the connector 10 as shown in FIG. 9. If the connector 10 is removed from the motherboard 700 by withdrawing the leads 50 from the through holes 710, the connector 10 cannot be reused unless a tool 400 is again provided to assist in the press-fitting of the tails 50 into another electrical device.

Figure 10:
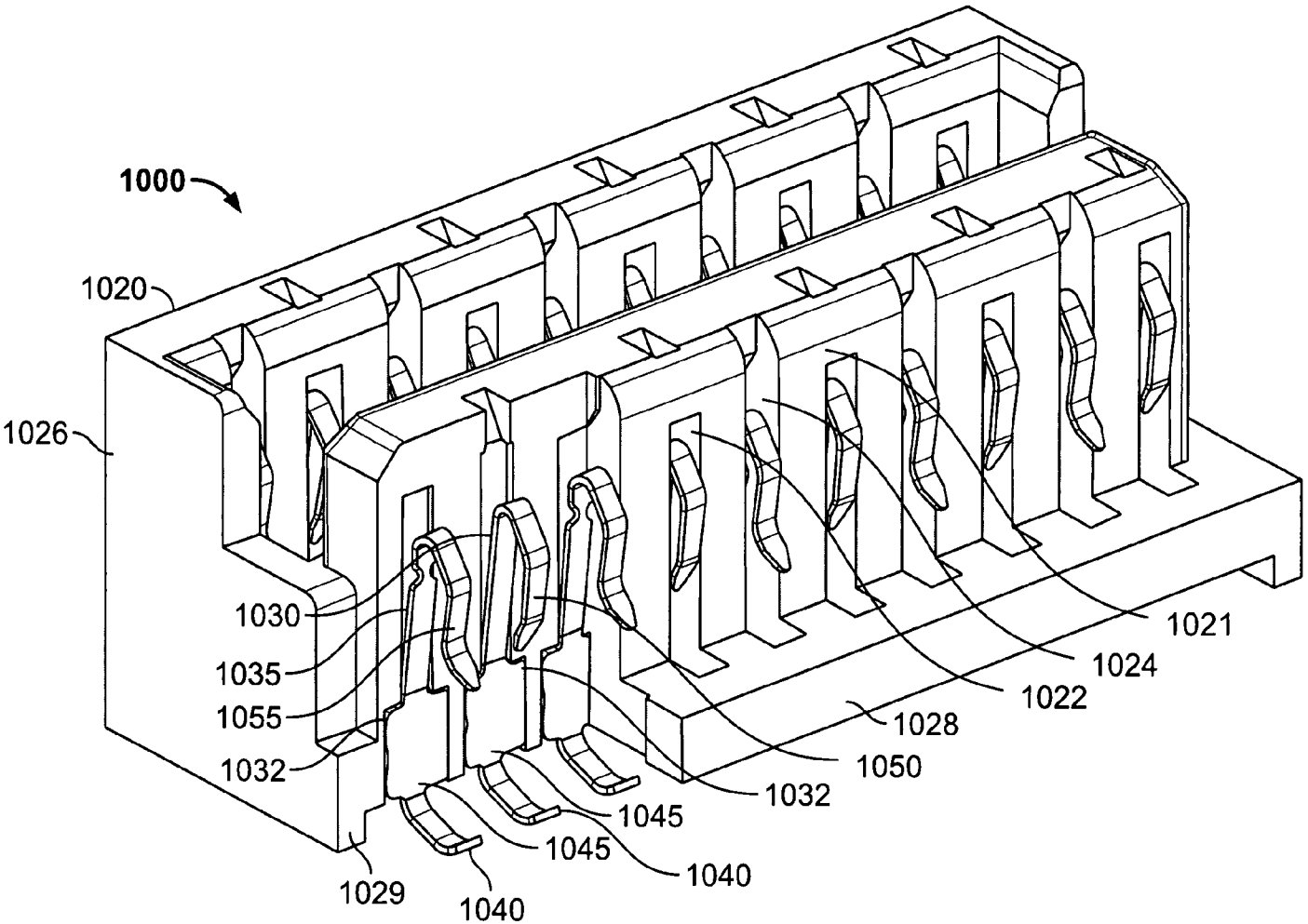
FIG. 10 illustrates an exemplary electrical connector according to a second embodiment of the invention.

A second embodiment of the single use security module first connector 1000 is depicted in FIG. 10. The first connector 1000 includes a housing 1020 and standard contacts 1030 and modified contacts 1035, as shown in the partial cutaway view of connector 1000 in FIG. 10. The standard contacts 1030 include a lead 1040, a body 1045, and a contact engaging tail 1050. The standard contacts 1030 are supported in the housing 1020 in standard slots 1022 The modified contact 1035 include a lead 1040, a body 1045, and a modified engaging tail 1055. The modified contacts 1035 are supported in the housing 1020 in modified slots 1024. As further shown in FIG. 10, housing 1020 further includes interlocking sidewalls 1026 and a bottom wall 1028. Bottom wall 1028 includes standoffs 1029.

The first connector 1000 is shown with two rows of contacts containing five standard slots 1022 and five modified slots 1024 in each row, however, each row may have any number of standard slots 1022 and modified slots, including zero. For example, a row may contain one or more standard slots 1022 and the other row may contain one or more modified slots 1024. Additionally, the first connector 1000 is shown with individually alternating standard slots 1022 and modified slots 1024, however, the standard slots 1022 and modified slots may be staggered in groups of two or more. Furthermore, the standard slots 1022 and the modified slots 1024 may also be grouped together in a row, for example, 5 modified slots together and 5 standard slots together.

Figure 11:
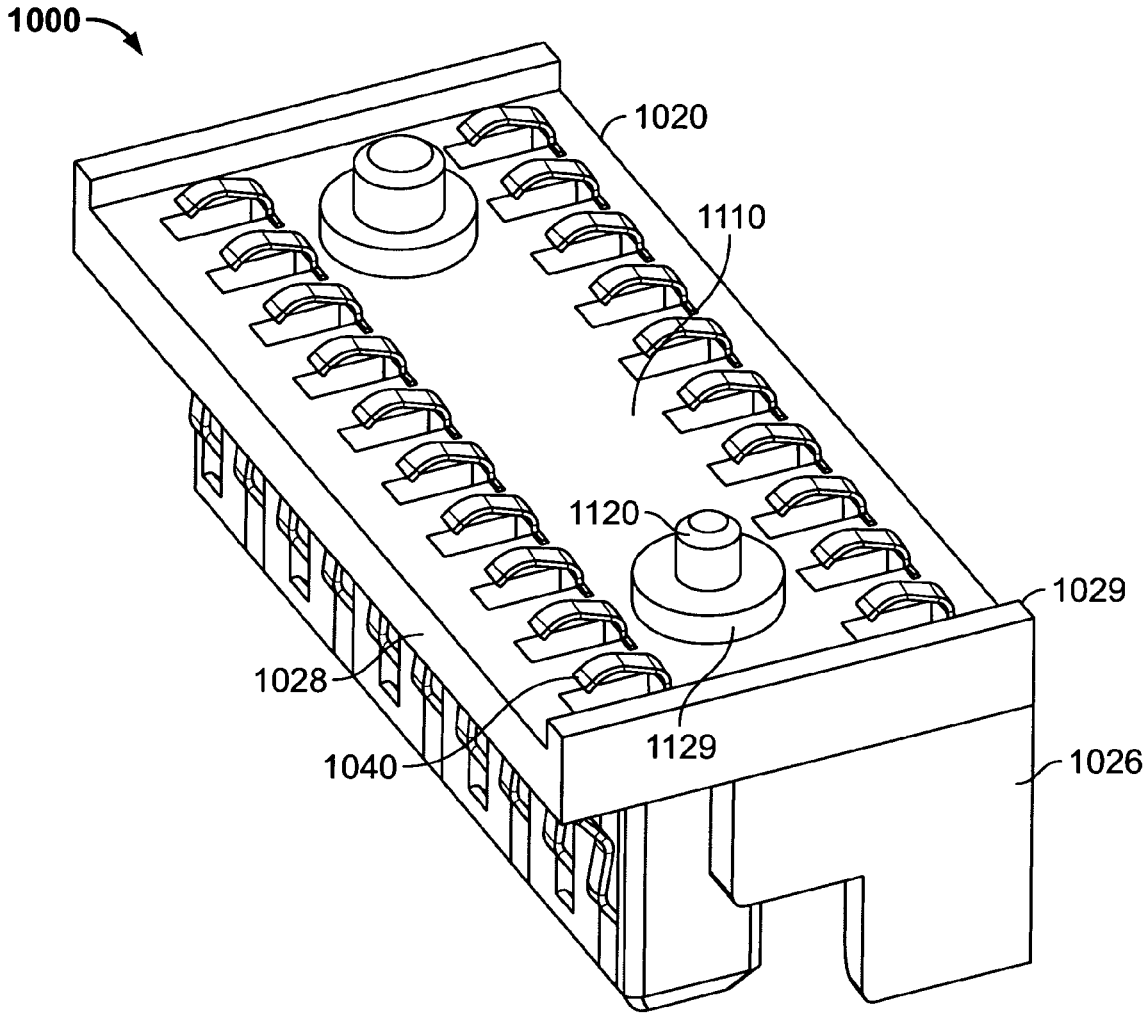
FIG. 11 illustrates a bottom view of an exemplary electrical connector according to a second embodiment of the invention.

A detailed bottom view of connector 1000 is shown in FIG. 11. As seen in FIG. 11, the bottom wall 1028 includes a housing lead side surface 1110. Alignment posts 1120 are positioned on the lead side surface 1110 as shown in FIG. 11. Alignment posts 1120 align the connector 1000 with a surface of an electrical device (not shown). The housing 1020 is shown with two alignment posts 1120 on the lead side surface 1110 of the housing 1020, but it is within the scope of the invention to include additional alignment posts or other alignment structures on the lead side surface 1110. FIG. 11 also shows standoffs 1029 positioned on the ends of lead side surface 1110. Additional standoffs 1129 are also provided. Further standoffs may be provided as necessary to provide support to the bottom wall 1028.

Figure 12:
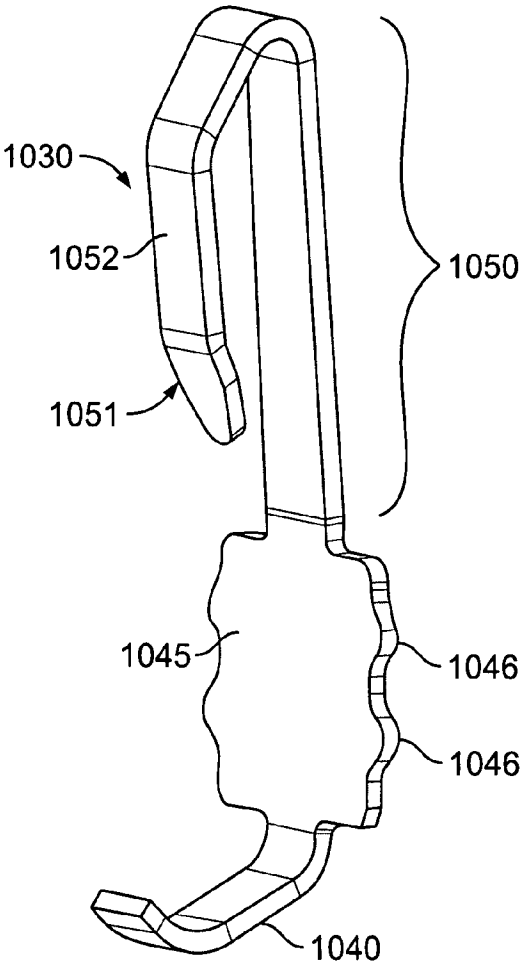
FIG. 12 illustrates an exemplary standard contact according to the second embodiment of the invention.

A detailed illustration of a standard contact 1030 is shown in FIG. 12. As shown in FIG. 12, the standard contact 1030 has a lead 1040, a body 1045 and an engaging tail 1050. The engaging tail 1050 includes a tip section 1051 that is directed towards the body 1045 as shown in FIG. 12. The engaging tail 1050 also includes an engaging surface 1052. The body 1045 includes retention shoulders 1046 for holding the standard contact 1030 in the standard slot 1022 of the housing 1020 by a friction fit.

Figure 13:
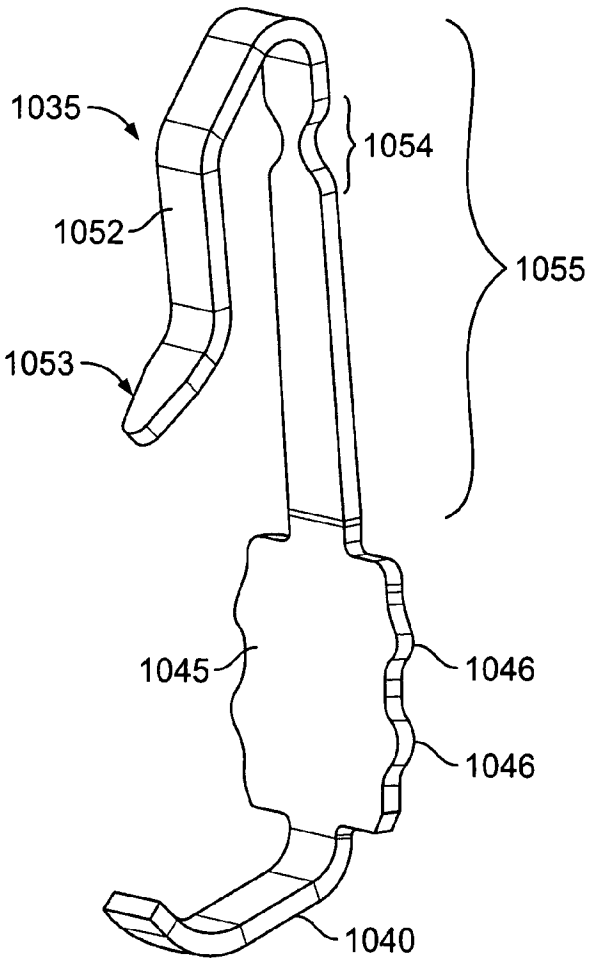
FIG. 13 illustrates an exemplary modified contact according to the second embodiment of the invention.

A detailed illustration of a modified contact 1035 is shown in FIG. 13. As shown in FIG. 13, the modified contact has a lead 1040, a body 1045, and a modified engaging tail 1055. The modified engaging tail 1055 includes a modified tip section 1053 that is directed away from the body 1045 as shown in FIG. 13. The modified engaging tail 1055 also includes an engaging surface 1052 and a frangible section 1054. The body 1045 includes retention shoulders 1046 that assist in holding the modified contact 1035 in the slot 1024 of the housing 1020 by a friction fit.

In the example of the modified contact shown in FIG. 13, the frangible section 1054 is shown having a reduced cross-section. However, the frangible section 1054 may be weakened by either mechanical design or chemical or metallurgical treatment to ensure that the modified contact 1035 is weakest at the frangible section 1054. The weakened mechanical design can be formed, for example, by reducing the cross-section, thinning the material, or providing for a weaker material at the frangible section 1054.

Both the standard contact 1030 and the modified contact 1035 are loaded into housing 1020 by inserting the engaging tail 1050 and modified engaging tail 1055 into the standard slot 1022 and the modified slot 1024, respectively, from the lead side surface 1110 of the housing 1020 until the contact body 1045 of both the standard contact 1030 and the modified contact 1035 abut the housing ledge 1032 as shown in FIG. 10.

Figure 14:
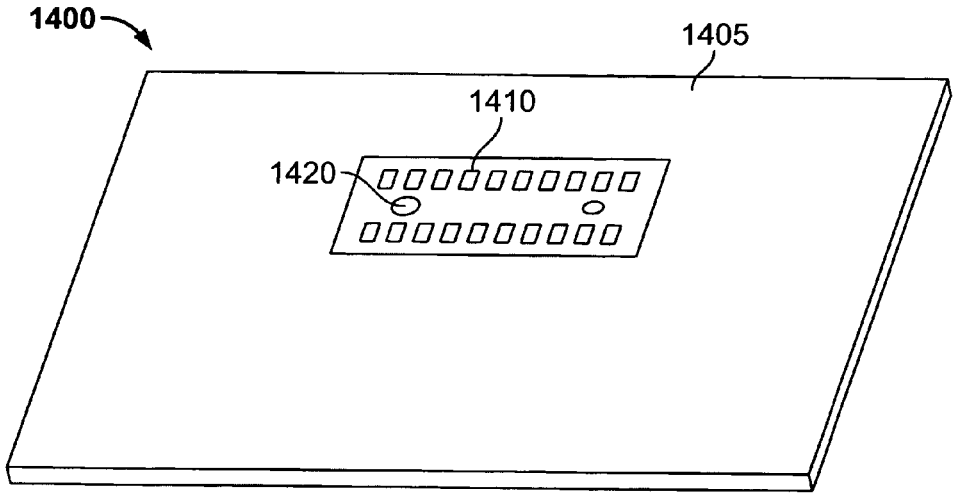
FIG. 14 illustrates a second exemplary motherboard.

A second exemplary motherboard 1400 having a motherboard surface 1405 supporting surface mount pads 1410 is shown in FIG. 14. The motherboard 1400 further includes alignment holes 1420. A first connector 1000 is brought into contact with motherboard 1400 to bring alignment posts 1120 into alignment with alignment holes 1420 and to position leads 1040 against surface mount pads 1410.

Figure 15:
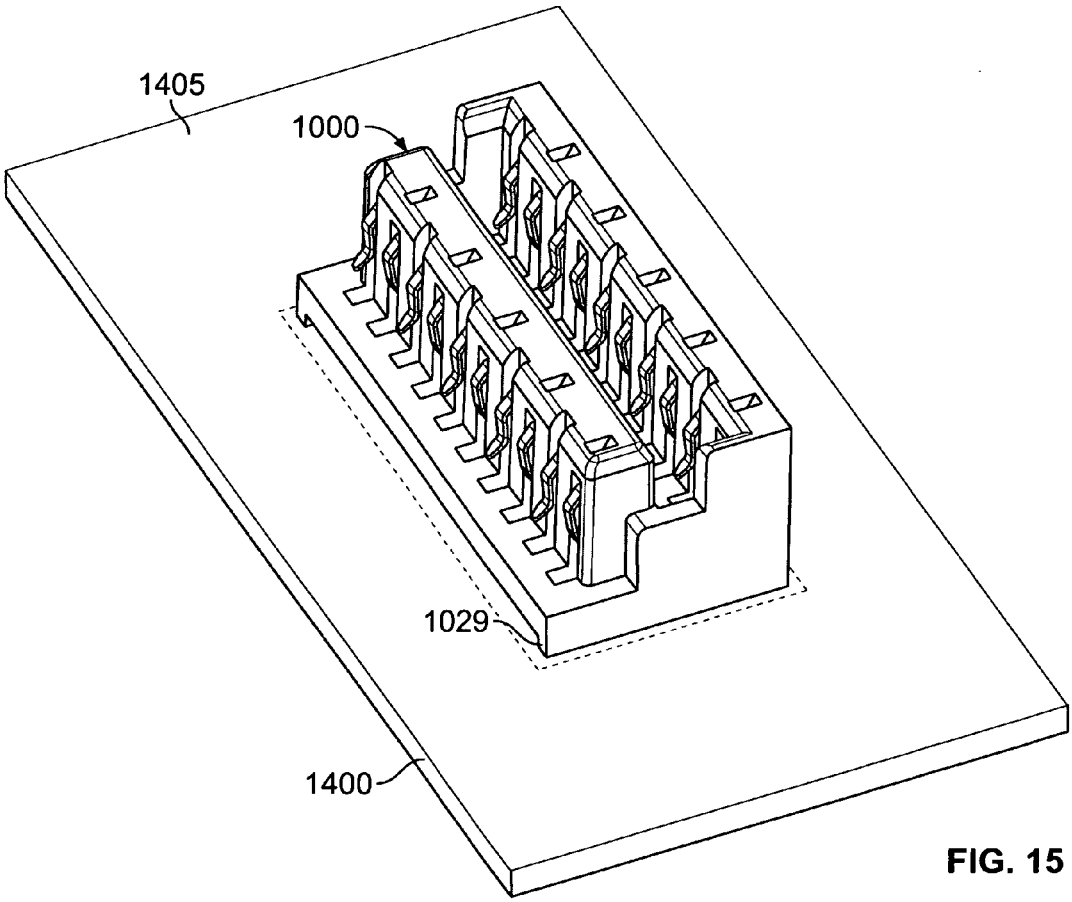
FIG. 15 illustrates an exemplary arrangement of a first connector according to the second embodiment connected to an exemplary motherboard.

The leads 1040 of the connector 1000 are then soldered to the surface mount pads 1410 of the motherboard 1400 to form the connector/motherboard arrangement as shown in FIG. 15. The standoffs 1029 separate the lead side surface 1010 of the first connector 1000 from the motherboard surface 1405 and facilitate soldering of the leads 1040 to the surface mount pads 1410. In such a manner, an electrical connection is established between the connector 1000 and the motherboard 1400.

Figure 16:
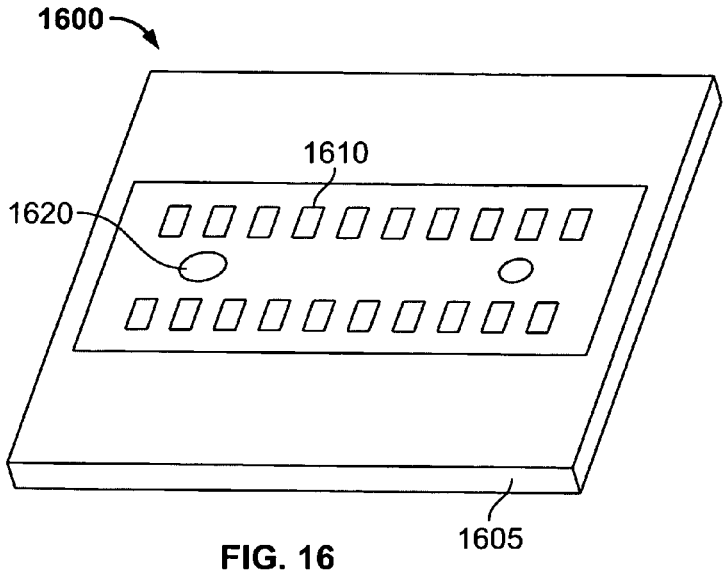
FIG. 16 illustrates a second exemplary daughter card.

A second exemplary daughter card 1600 having a daughter card surface 1605 that supports surface mount pads 1610 is shown in FIG. 16. The daughter card 1600 further includes alignment holes 1620. A second connector 1100 is brought into contact with the daughter card 1600 so that the alignment posts 1020 are aligned with alignment holes 1620 and the leads 1040 are positioned against surface mount pads 1610. The second connector 1100 has a substantially identical housing 1020 as the first connector 1000. However, in the second connector 1100, the standard contacts 1030 are positioned in the modified slots 1024 and the modified contacts 1035 are positioned in standard slots 1022.

Figure 17:
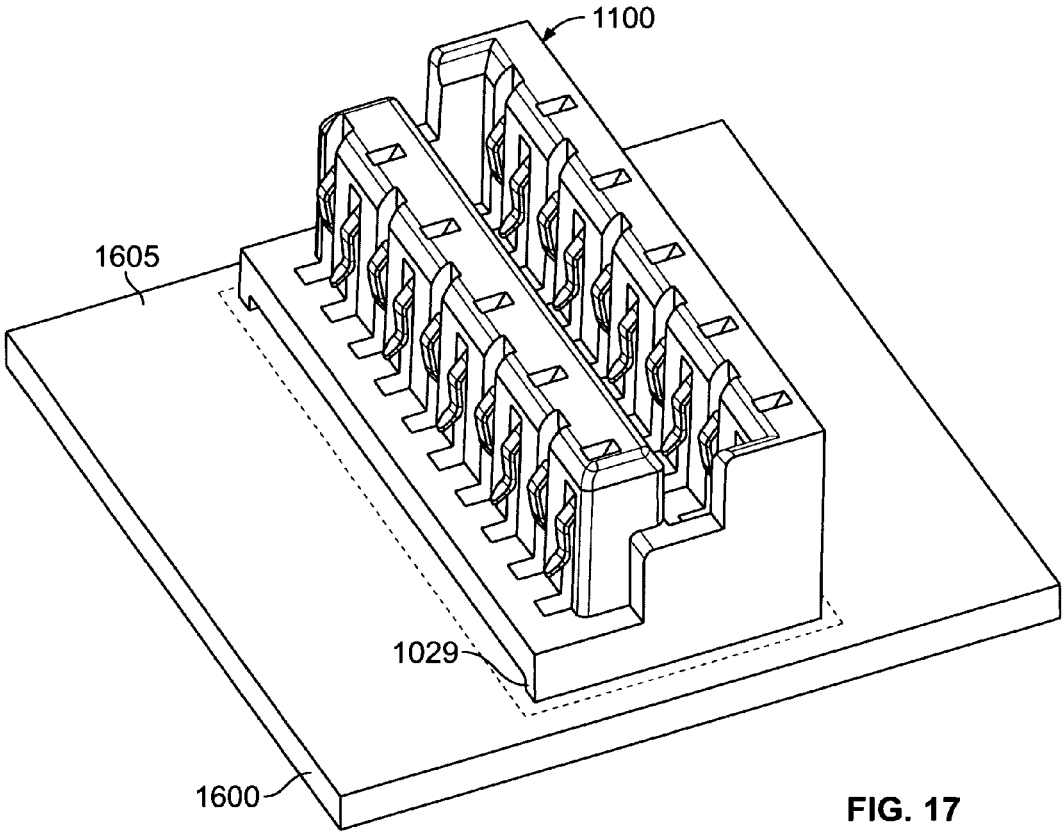
FIG. 17 illustrates an exemplary arrangement of a second connector according to the second embodiment connected to an exemplary daughter card.

The leads 1040 of the second connector 1100 are then soldered to the surface mount pads 1610 of the daughter card 1600 to form a connector/daughter card arrangement as shown in FIG. 17. The standoffs 1029 separate the lead side surface 1010 of the connector 1010 from the motherboard surface 1605 and facilitate soldering of the leads 1040 to the surface mount pads 1610. In such a manner, an electrical connection is established between the connector 1100 and the motherboard 1600.

Figure 18:
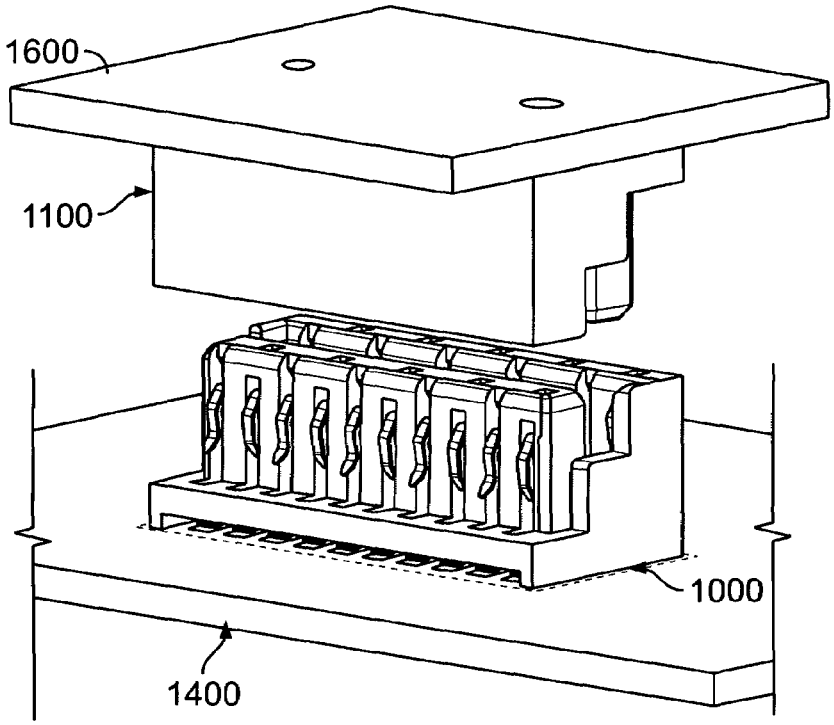
FIG. 18 illustrates an exemplary arrangement of a first connector connected to a motherboard aligned with a second connector connected to a daughter card.
Figure 19:
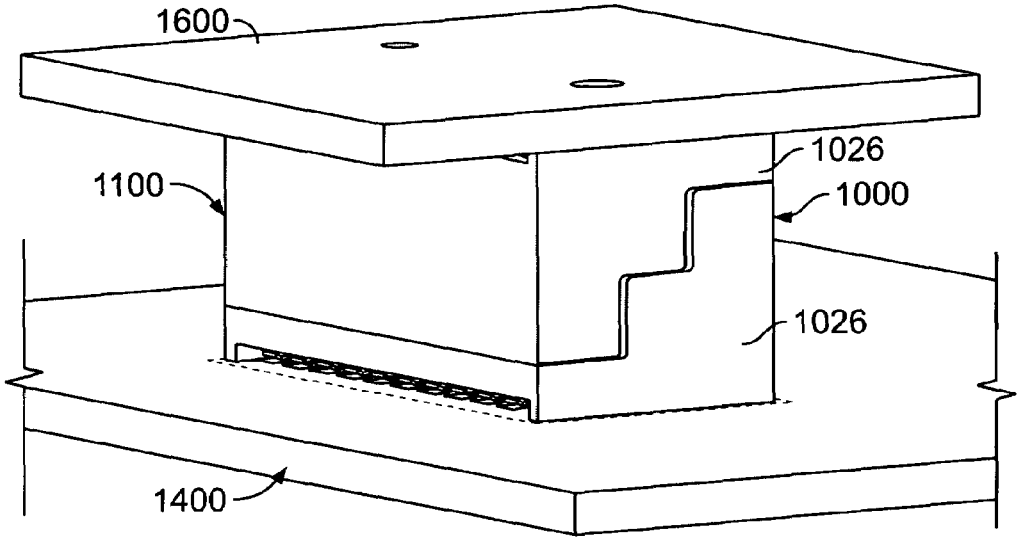
FIG. 19 illustrates an exemplary arrangement of a first connector connected to a motherboard mated to a second connector connected to a daughter card.

The second connector 1100 attached to the daughter card 1600 is brought into contact with the first connector 1000 attached to the motherboard 1400 as shown in FIG. 18. As seen in FIG. 18, reversing the orientation of the second connector 1100 with respect to the first connector 1000 and aligning the second connector 1100 with the first connector 1000 allows the second connector 1100 and the first connector 1000 to be mated. In such a manner, the standard slots 1022 of the first connector 1000 are aligned with the standard slots 1022 of the second connector 1100, and the modified slots 1024 of the first connector 1000 are aligned with the modified slots 1024 of the second connector 1100. The interlocking sidewalls 1026 of the second connector 1100 are configured to mate with the interlocking sidewalls 1026 of the first connector 1000 when the second connector 1100 and the first connector 1000 are mated as shown in FIG. 19.

Figure 20:
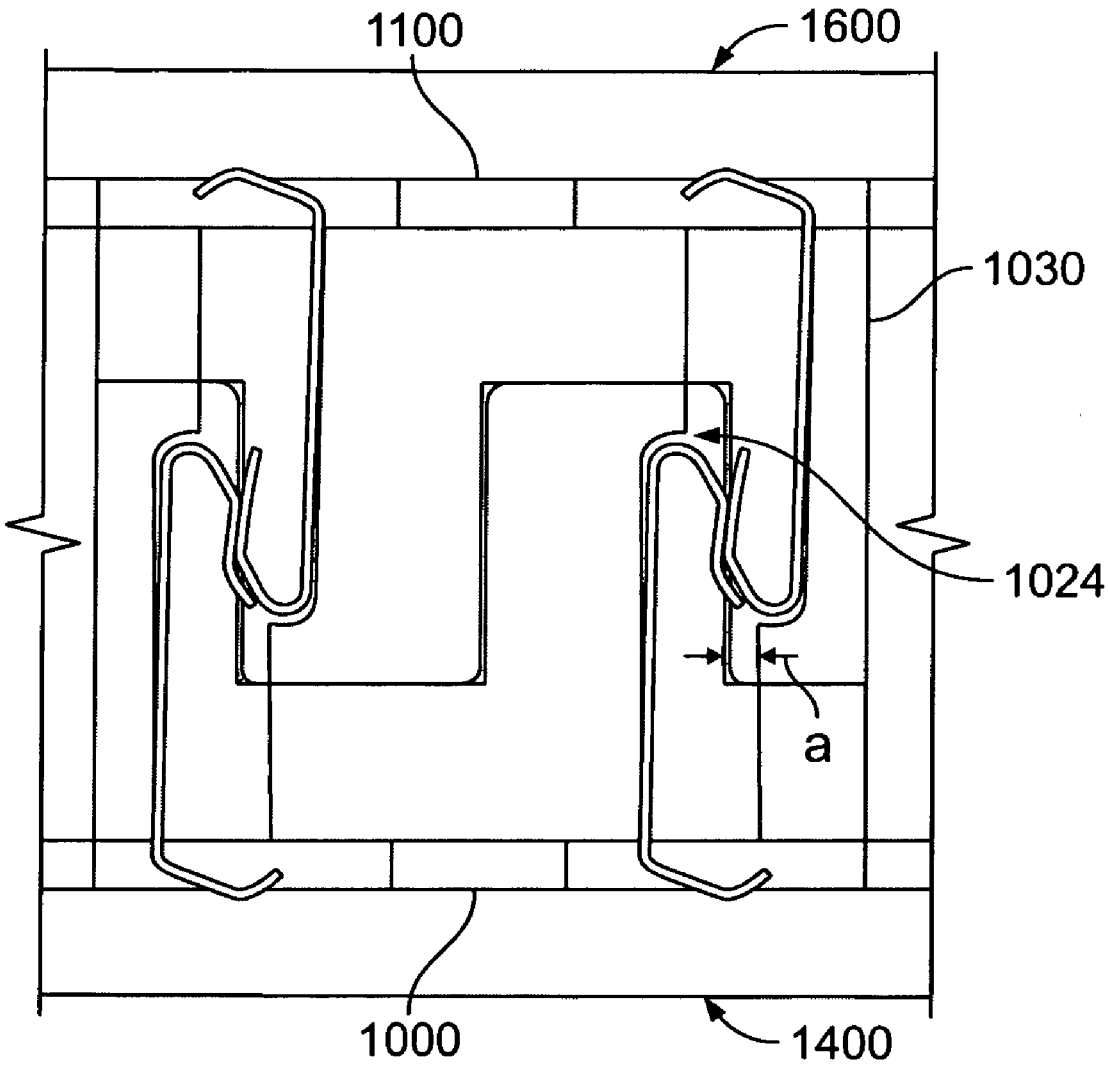
FIG. 20 illustrates a cross-sectional view of a first connector connected to a motherboard mated with a second connector connected to a daughter card taken across modified slots.

A first cross section of a fully mated first connector 1000 connected to motherboard 1400 and a second connector 1100 connected to a daughter card 1600 taken across a standard slot 1024 of both the first connector 1000 and the second connector 1100 is shown in FIG. 20. As shown in FIG. 20, the modified slot 1024 of the first connector 1000 supports a modified contact 1035. As also shown in FIG. 20, the modified slot 1024 of the second connector 1100 supports a standard contact 1030. As can be seen in FIG. 20, the mating of the modified slot 1024 of the first connector 1000 with the modified slot 1024 of the second connector 1100 forms a space (a) that allows the second connector 1100 to become un-mated from the first connector 1000 without engaging the modified tip section 1053. In this configuration, the second connector 1100 can be un-mated from the first connector 1000 without deforming the modified tip section 1053 of the modified contact 1035 of the first connector 1100.

Figure 21:
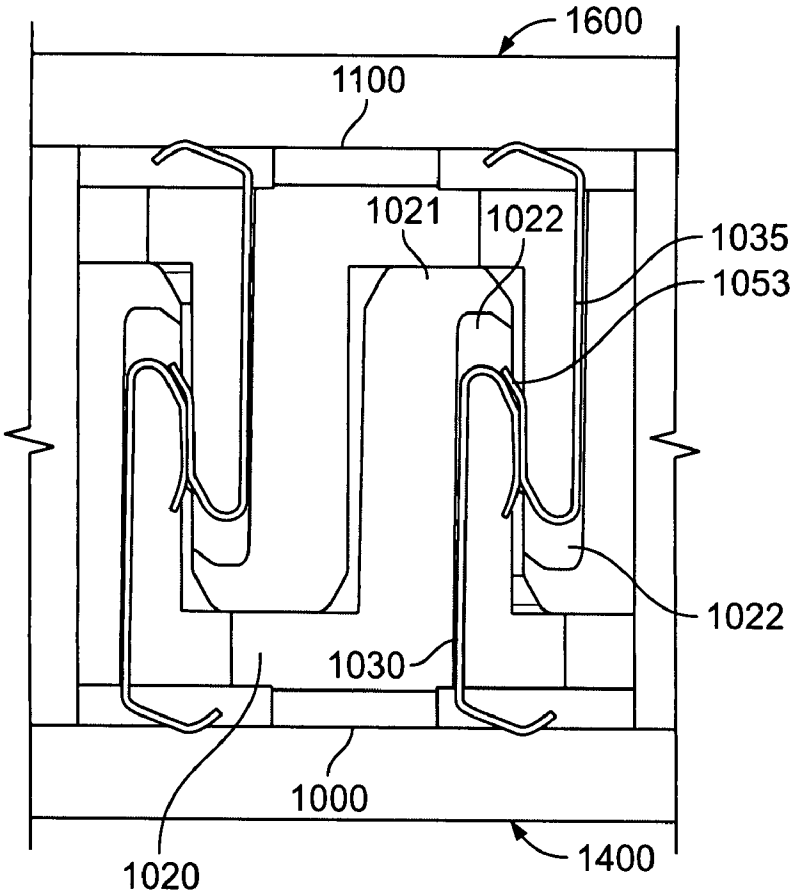
FIG. 21 illustrates a cross-sectional view of a first connector connected to a motherboard mated with a second connector connected to a daughter card taken across standard slots.

A second cross section of a fully mated first connector 1000 connected to motherboard 1400 and second connector 1100 connected to daughter card 1600 taken across a standard slot 1022 of the first connector 1000 and a standard slot 1022 of the second connector 1100 is shown in FIG. 21. As shown in FIG. 21, the standard slot 1022 of the first connector 1000 is partially bound by slot overhang 1021, which is a part of housing 1020 of the first connector 1000. The standard slot 1022 of the second connector 1100 supports modified contact 1035.

Figure 22:
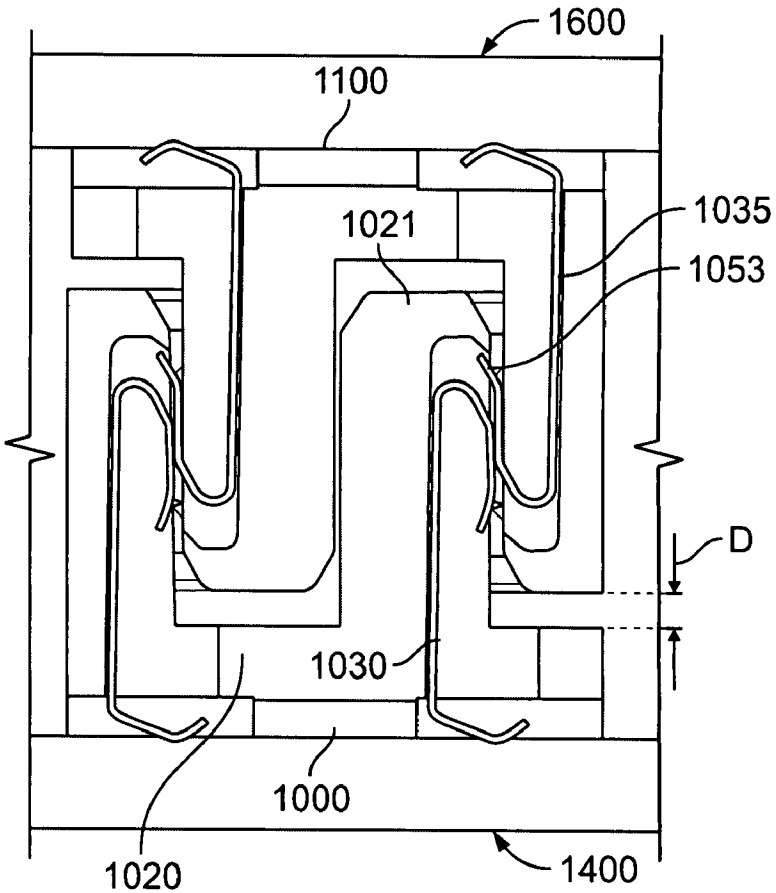
FIG. 22 illustrates a cross-sectional view of a first connector connected to a motherboard un-mated by a distance D from a second connector connected to a daughter card taken across standard slots.

FIG. 22 illustrates the un-mating of second connector 1100 from the first connector 1000 at the second cross-section when the second connector 1100 is separated from the first connector 1000 by a distance D. At distance D, the modified tip section 1053 of the modified contact 1035 first engages the slot overhang 1021 of housing 1020 of the first connector 1000.

Figure 23:
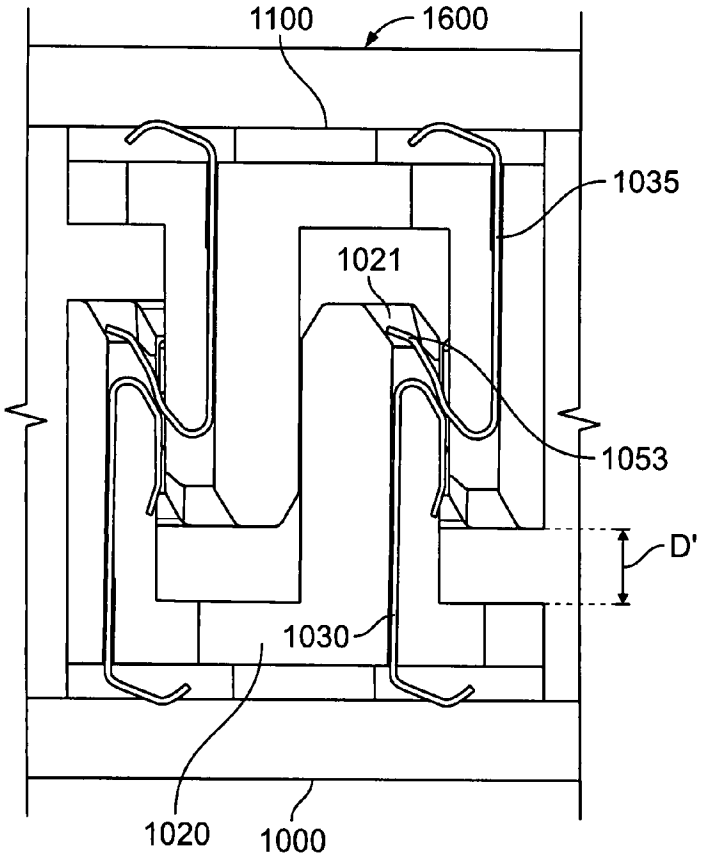
FIG. 23 illustrates a cross-sectional view of a first connector connected to a motherboard un-mated by a distance D' from a second connector connected to a daughter card taken across standard slots.

FIG. 23 illustrates the un-mating of the second connector 1100 from the first connector 1000 at the second cross-section when the second connector 1100 is separated from the first connector 1000 by a distance D'. At distance D', the modified tip section 1053 of the modified contact 1035 has been deformed by the slot overhang 1021 of housing 1020 of the first connector 1000.

Figure 24:
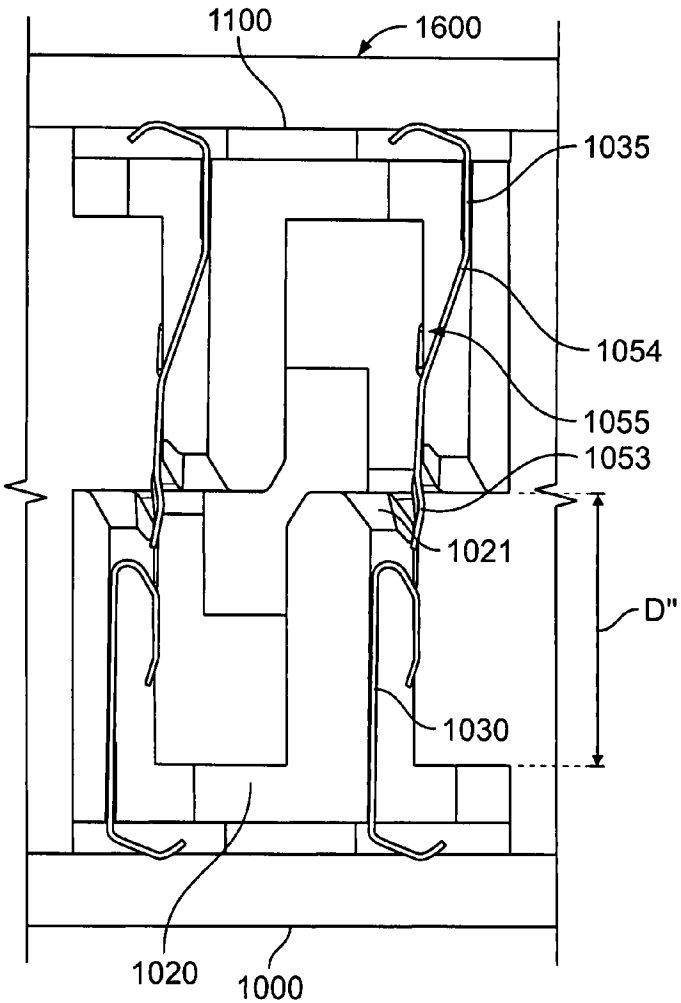
FIG. 24 illustrates a cross-sectional view of a first connector connected to a motherboard un-mated by a distance D" from a second connector connected to a daughter card taken across standard slots.

FIG. 24 illustrates the un-mating of the second connector 1100 from the first connector 1000 at the second cross-section when the second connector 1100 is separated from the first connector 1000 by a distance D". At distance D", the modified tip section 1053 has been substantially deformed by the slot overhang 1021 of housing 1020 of the first connector 1000. FIG. 24 also shows the modified contact 1035 has bent at the frangible section 1054 to substantially deform the modified tail 1055 of the modified contact 1035.

When the second connector 1100 is fully un-mated from first connector 1000, the modified tail 1055 is either fully deformed or broken away from the modified contact 1035 at the frangible section 1054. In either condition, the connector 1100 is rendered unusable.

It may be desirable to render first connector 1000 alone, or with the second connector 1100, unusable after mating, and therefore, modified contacts 1035 may be loaded in the standard slots 1022 of the first connector 1000. In such a manner, the modified contacts 1035 of the first connector 1000 would be deformed when the second connector 1100 is un-mated from the first connector 1000, rendering the first connector 1000 unusable. Additionally, it may be desirable to load only standard contacts 1030 into the first connector 1000.

The standard contacts 1030 and the modified contacts 1035 may be formed of a highly conductive metal or alloy, such as phosphor bronze. The housing 1020 may be formed of a high temperature liquid crystalline polymer (LCP) or other known industry acceptable non-conductive high temperature resin.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A single use electrical connector assembly, comprising:

a housing having a lead side surface, a tail side surface which is opposite to the lead side surface, and an open slot extending into the housing from the lead side surface;

at least one electrical contact held by the housing, the at least one electrical contact having a first end configured to make a first connection with a first electrical device proximate to the lead side surface of the housing, a second end configured to make a second connection with a second electrical device proximate to the tail side surface of the housing, and a compliant jog section disposed in a groove which is open to the open slot; and a tool that mates with the housing, the tool is configured to be received in the open slot and to overlie the compliant jog section;

wherein the compliant jog section is configured to deform when attempting to connect the second end to the second electrical device without the tool mated to the housing such that the second end is prevented from making the second connection with the second electrical device, and wherein the tool presses the compliant jog section and prevents the compliant jog section from bending into the open slot when the tool is mated to the housing.

2. The assembly of claim 1, wherein the first end is a solder lead and the second end is a press-fit connection.

3. The assembly of claim 2, wherein the second end comprises a compliant eye-of-the-needle tail.

* * * * *